US008607601B1

(12) United States Patent
Wickesberg

(10) Patent No.: US 8,607,601 B1
(45) Date of Patent: Dec. 17, 2013

(54) LOCK

(76) Inventor: Launce Wickesberg, Milwaukee, WI (US)

( * ) Notice: Subject to any disclaimer, the term of this patent is extended or adjusted under 35 U.S.C. 154(b) by 0 days.

(21) Appl. No.: 13/337,891

(22) Filed: Dec. 27, 2011

Related U.S. Application Data

(60) Provisional application No. 61/427,535, filed on Dec. 28, 2010.

(51) Int. Cl.
*E05B 73/00* (2006.01)

(52) U.S. Cl.
USPC ..... 70/58; 70/15; 70/57.1

(58) Field of Classification Search
USPC ..... 70/15, 16, 18, 57, 57.1, 58, 59, 61
See application file for complete search history.

(56) References Cited

U.S. PATENT DOCUMENTS

| | | | | |
|---|---|---|---|---|
| 880,723 | A | 3/1908 | Cumming | |
| 1,343,962 | A | 6/1920 | Byrrne | |
| 2,390,724 | A | 12/1945 | Mays | |
| 2,418,039 | A | 3/1947 | Mays | |
| 4,796,768 | A | 1/1989 | Stuckey | |
| 4,896,517 | A * | 1/1990 | Ling | 70/30 |
| 4,984,698 | A | 1/1991 | Stuckey | |
| 5,464,109 | A | 11/1995 | Greenwald | |
| 5,586,670 | A | 12/1996 | Greenwald | |
| 5,602,530 | A * | 2/1997 | Holmgren | 340/572.1 |
| 5,655,392 | A * | 8/1997 | Holmgren | 70/57.1 |
| 5,671,506 | A * | 9/1997 | Eliasson | 24/19 |
| 5,794,464 | A * | 8/1998 | Yeager et al. | 70/57 |
| 5,960,652 | A * | 10/1999 | Marmstad | 70/49 |
| 6,098,256 | A * | 8/2000 | Poussard | 24/704.1 |
| 6,326,890 | B1 * | 12/2001 | Costa | 340/572.9 |
| 6,449,991 | B1 * | 9/2002 | Hogan | 70/57.1 |
| 6,912,878 | B2 | 7/2005 | Belden, Jr. | |
| 7,162,899 | B2 * | 1/2007 | Fawcett et al. | 70/57 |
| 7,497,101 | B2 * | 3/2009 | Fawcett et al. | 70/57 |
| 7,650,768 | B2 * | 1/2010 | Fawcett et al. | 70/58 |
| 7,984,629 | B2 * | 7/2011 | Xiaobin | 70/57 |
| 2004/0206719 | A1 | 10/2004 | Haggard et al. | |
| 2005/0211658 | A1 | 9/2005 | Bagration De Ulloa | |

* cited by examiner

*Primary Examiner* — Christopher Boswell
(74) *Attorney, Agent, or Firm* — Boyle Fredrickson S.C.

(57) ABSTRACT

A lock is provided including a lower housing including an engagement member attached thereto, a shaft engaged with the engagement member opposite the lower housing, a ratcheting mechanism operably connected to the shaft to control the rotation of the shaft and a locking mechanism operably engaged with the ratcheting mechanism, the locking mechanism being selectively operable to control the operation of the ratcheting mechanism and the rotation of the lower housing and engagement member with regard to the shaft and ratcheting mechanism to engage the lock over an opening in a container to selectively prevent access to a material held therein.

17 Claims, 5 Drawing Sheets

LOCK

CROSS-REFERENCE TO RELATED APPLICATIONS

This application claims priority from U.S. Provisional Patent Application Ser. No. 61/427,535 filed on Dec. 28, 2010, the entirety of which is hereby expressly incorporated by reference herein.

FIELD OF THE INVENTION

The present invention relates to locking devices, and more specifically to a locking device for securing access to a bottle and the contents contained therein.

BACKGROUND OF THE INVENTION

Many different types of fluent materials, such as powders, pellets, granules, fluids and liquids are held in various types of containers, such as bottles. The containers can vary in size and shape, but all include an opening, such as a spout in order, to dispense the liquid form the bottle in an easy manner while retaining the integrity of the bottle.

To retain the material in the container, a number of different types of removable closures have been designed to engage and seal the container spout or opening. However, while closures of this type are designed to be easily engaged and removed from the container, this feature of the closures also renders them unsuitable for restricting access to the material in the container when desired.

Therefore, it is desirable to develop a lockable structure for use as a closure for various types of containers, such as bottles, that can effectively close off the opening in the container and be secured to the container in a manner that prevents access to the contents of the container until the closure is unlocked and removed. Further, the structure should be readily removable from the container when it is desired to dispense the material from the container.

SUMMARY OF THE INVENTION

According to one aspect of the present invention, a lock is provided that is attachable around the opening in a container, such as the neck of a bottle, to be disposed over the opening or spout for the container. The lock includes a lower housing or sleeve that is open at both ends and includes a gear secured therein. Within the opening of the gear is disposed a ratcheting mechanism that is operably engaged with a shaft extending downwardly from the ratcheting mechanism. The shaft is attached to an engagement structure that can engage the neck of the bottle. The engagement structure includes a flexible engagement member thereon located generally opposite the shaft that is also affixed to the lower housing opposite the engagement structure. The lower housing can move around the shaft in order to engage the engagement member with the container around the opening, e.g., the bottle neck.

Opposite the shaft and the engagement member, the ratcheting mechanism is connected to a rod that extends into an upper housing. The upper housing encloses a locking mechanism that engages the rod connected to the ratcheting mechanism and that is operable to control the effect of the ratcheting mechanism on the gear and the lower housing. Thus, when the locking mechanism is in an engaged position, the ratcheting mechanism is oriented to enable the rotation of the gear and lower housing in only a single direction, allowing the engagement member to be tightened into engagement with the bottle and retained in that position Alternatively, when the locking mechanism is in a disengaged position, the ratcheting mechanism is oriented such that the gear and lower housing are free to rotate in either direction, enabling the engagement member to be disengaged from the container.

Numerous other aspects, features, and advantages of the present invention will be made apparent from the following detailed description together with the drawings figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
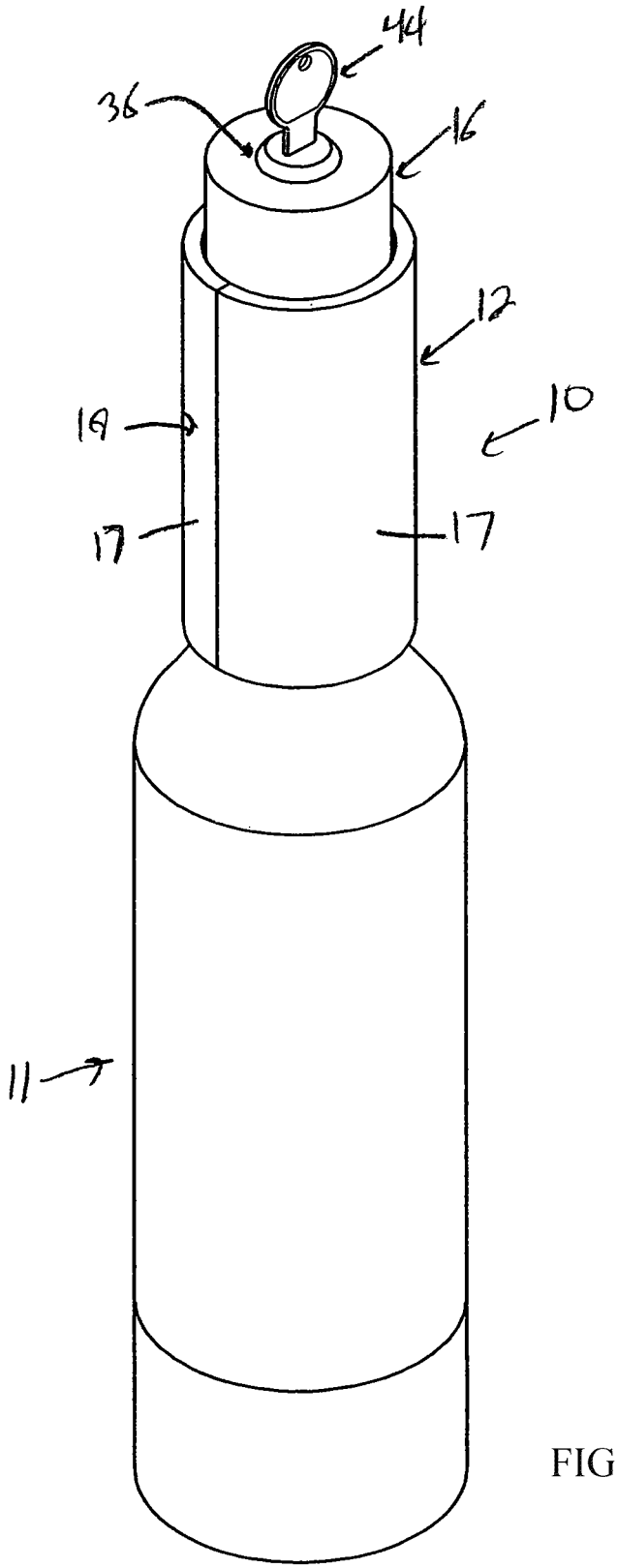
FIG. 1 is an isometric view of a lock constructed according to the present disclosure engaged with a bottle.

With reference now to the drawing figures in which like reference numerals designate like parts throughout the disclosure, a lock 10 for attachment to a container, such as a bottle 11 over the opening or spout 13 of the bottle 11 is shown in FIG. 1.

Figure 2:
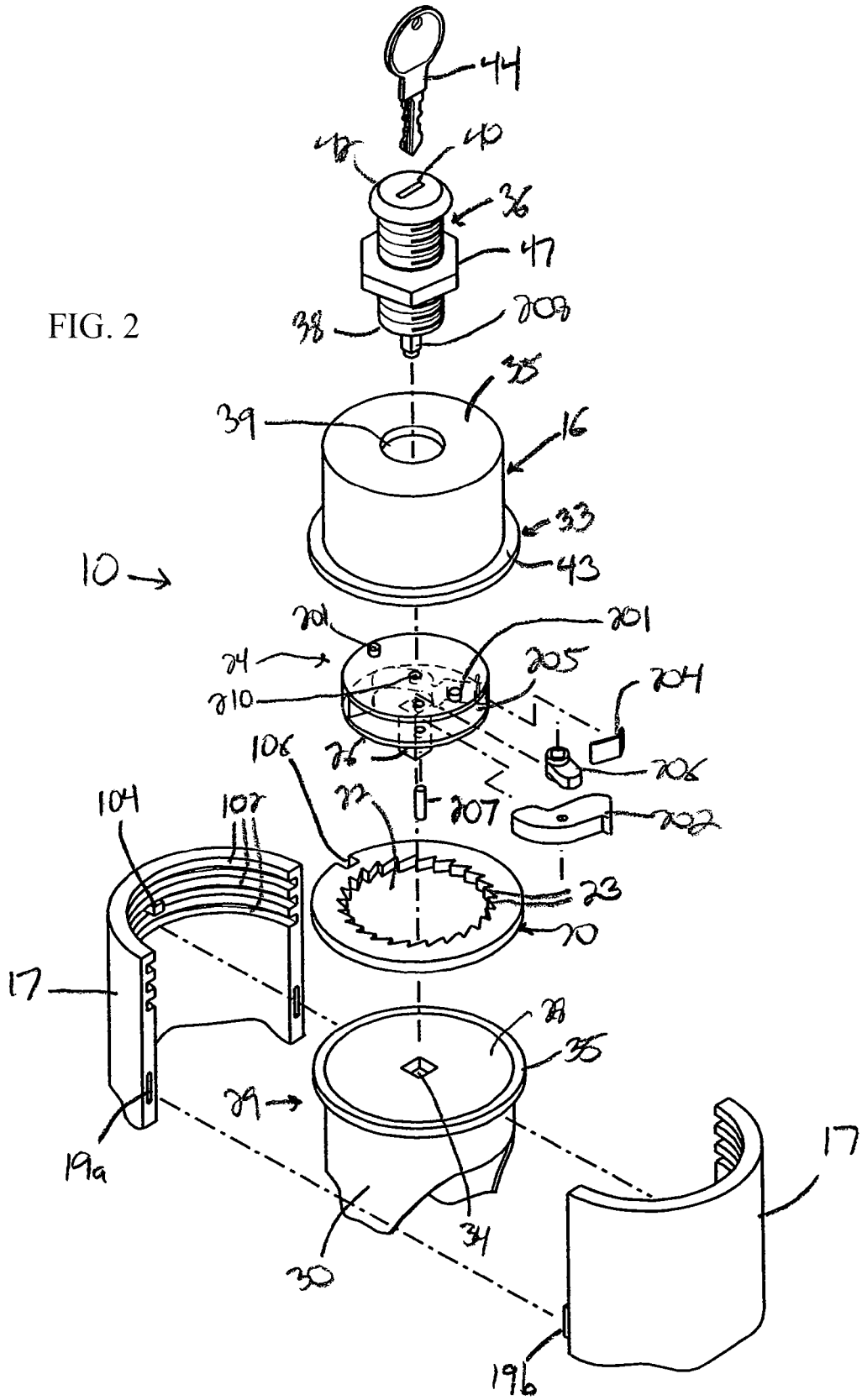
FIG. 2 is an exploded view of the lock of FIG. 1.
Figure 3:
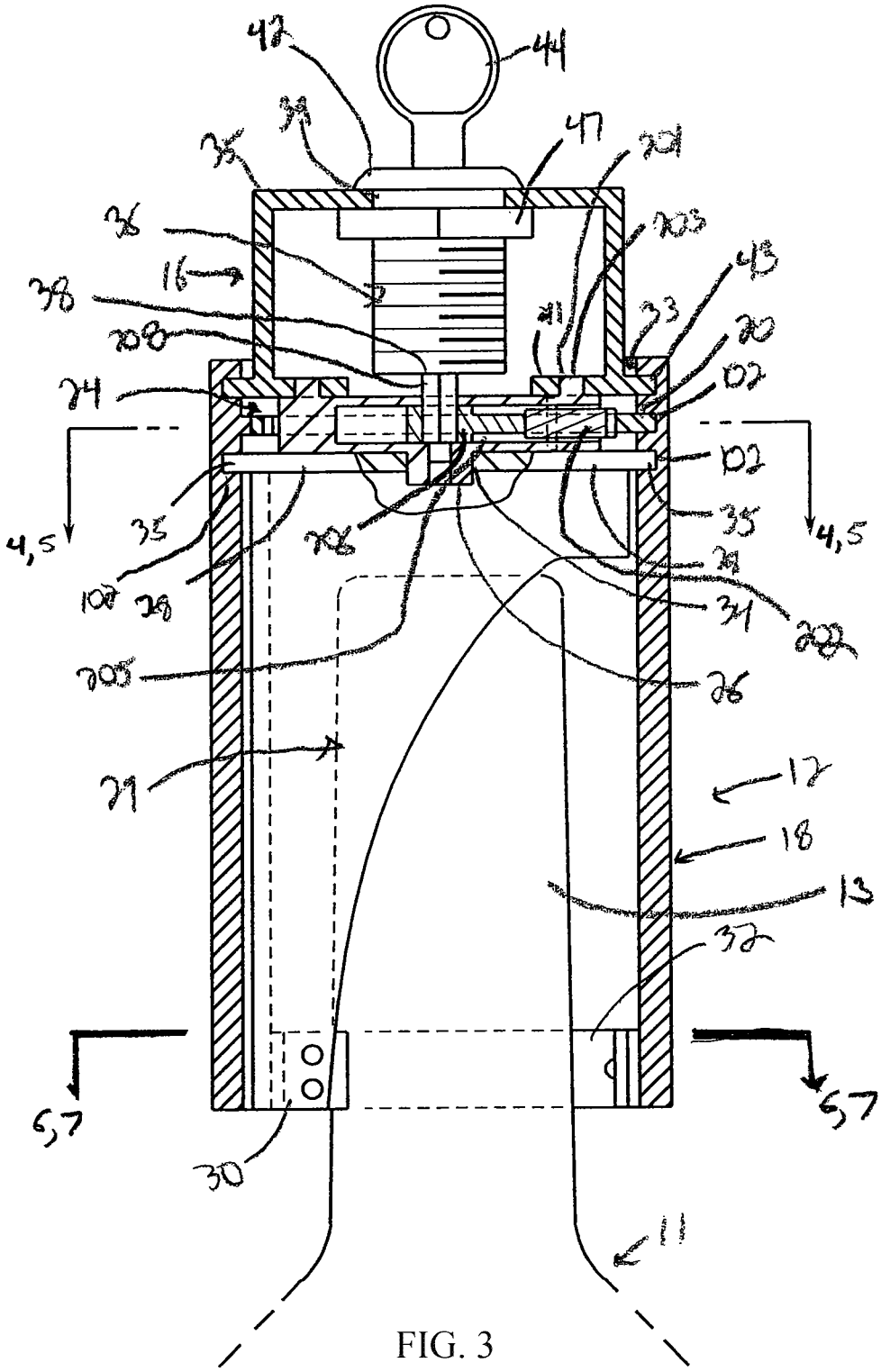
FIG. 3 is a cross-sectional view of the lock of FIG. 1.

Referring now to FIGS. 2 and 3, the lock 10 includes a lower housing 12, and an upper housing 16. The lower housing 12 is formed of any suitable material and with any suitable shape, and in one embodiment is formed as a metal cylinder 18 open at both ends. The cylinder 18 can be formed as a single piece, or as in the illustrated embodiment can be formed as a pair of halves 17 each including engageable locking members 19*a* and 19*b* to hold the halves 17 in engagement with one another to form the cylinder 18.

The cylinder 18 includes a gear 20 disposed within the cylinder 18 that includes a central opening 22 with a number of teeth 23 formed therein around the circumference of the opening 22. The gear 20 is positioned within the lower housing 12 by placing the peripheral edge 100 of the gear within one of a number of circumferential grooves 102 formed on the interior of the cylinder 18. The gear 20 can be held in position in the groove 102 to enable rotation of the gear 20 in conjunction with the cylinder 18 by a tab 104 disposed in the groove 102 that is engaged by a complementary notch 106 formed in the edge 100 of the gear 20.

The upper housing 16 can be formed similarly to the lower housing 12, and is formed to have a generally cylindrical shape with a closed top end 35 and an open bottom end 37 which is disposed in the cylinder 18 forming the lower housing 12. The bottom end 37 includes a peripheral rim 33 that has a radially inwardly extending portion 41, and a radially outwardly extending portion 43 that is engaged with one of the grooves 102 in the cylinder 18 to retain the upper housing 16 on the lower housing 12. The rim 33 is positioned within the groove 102 such that the rim 33, and thus the upper housing 16, is rotatable with regard to the lower housing 12.

Looking now at FIGS. 2-5, within the central opening 22 is disposed a ratcheting mechanism 24 that engages the teeth 23 in the opening 22. The mechanism 24 includes a ratchet housing 200 located within the opening 22, but not engaging the teeth 23, and a pawl 202 pivotally mounted within the housing 200. The ratchet housing 200 includes a number of posts 201 that extend upwardly from the housing 200 to be engaged within complementary bores 203 formed in the inwardly extending portion 41 of the rim 33 to fix the ratchet housing 200 to the upper housing 16

The pawl 202 can be moved from an engaged position where the pawl 202 extends outwardly from the housing 200 to engage the teeth 23, thereby causing the gear 20 to be able to move around the housing 200 in only one direction, to a disengaged position where the pawl 202 is spaced from the teeth 23, such that the gear 20 can rotate around the housing 200 in either direction. In the illustrated embodiment, the pawl 202 is pivotally disposed within a slot 205 in the housing 200 by a pivot pin 207 and biased into the engagement position of FIG. 4 with the teeth 23 by a biasing or spring member 204 disposed within the slot 205 and engaged with the pawl 202. The pawl 202 can be selectively disengaged from the teeth 23 by an arm 206 pivotally mounted within the slot 205 of the housing 200 adjacent the pawl 202. The arm 206 is engaged with a rod 208 that extends into the slot 205 in the housing 200 through an aperture 210 and is operably connected opposite the arm 206 to a locking mechanism 36 disposed within the upper housing 16. The rod 208 is engaged with the arm 206 in a manner that enables the arm 206 to rotate in conjunction with the rod 208 as a result of the operation of the locking mechanism 36 to selectively disengage the pawl 202 from the teeth 23 against the bias of the biasing member 204, in a manner to be described.

Looking now at FIGS. 2, 3 and 5-6, opposite the locking mechanism 36, the housing 200 also includes a shaft 26 extending downwardly from, and optionally integrally formed with the housing 200. Within the lower housing 12, the shaft 26 is connected to an upper end 28 of an engagement structure 29 that also includes a lower end 30 that extends downwardly parallel to the housing 12. The engagement structure 29 can take any desired form, but in the illustrated embodiment is formed with a tapered cylindrical shape. Opposite the upper end 28, the lower end 30 is attached to one end of a flexible engagement member 32. The opposite end of the engagement member 32 is secured directly to the lower housing 12.

The upper end 28 of the engagement structure 29 is formed with a peripheral rim 35 similar to the outwardly extending portion 43 of the rim 33 of the upper housing 16 that can be engaged with one of the grooves 102 in the cylinder 18 in order to position the engagement structure 29 where desired within the cylinder 18. Further, the rim 35 of the upper end 28 is rotatably positioned within the groove 102, such that the cylinder 18 and gear 20 can be rotated with regard to the upper end 28 and engagement structure 29. The shaft 26 is engaged within an aperture 34 in the upper end 28 such that the housing 200 is fixed between the upper end 28 and the rim 33 of the upper housing 16. In this configuration, the upper housing 16, the ratchet housing 200 and the engagement structure 29 remain stationary when the cylinder 18 and gear 20 are rotated. To facilitate this connection between the shaft 26 and the upper end 28 of the engagement structure 29, in the illustrated embodiment, the shaft 26 and the aperture 34 are formed to be square in cross section to connect this housing 200 and the engagement structure 29 in this manner.

Looking now at FIGS. 2 and 3, the top end 35 of the upper housing 16 includes an opening 39 within which is disposed the locking mechanism 36. The locking mechanism 36 can have any desired shape or configuration, but in one embodiment is formed as a conventional key-operated locking mechanism 36. In this embodiment, the mechanism 36 is connected to the rod 208 at a lower end 38 adjacent the bottom end 37 of the upper housing 16, and has a key slot 40 at an upper end 42 located within the opening 39 of the top end 35 of the upper housing 16. The exterior surface of the mechanism 36 is threaded such that a nut 47 can be engaged with the mechanism 36 within the upper housing 16 in contact with the top end 35 to hold the mechanism 36 in position on the upper housing 16. A key 44 can be inserted into the slot 40 to operate and engage and disengage the mechanism 36.

Figure 4:
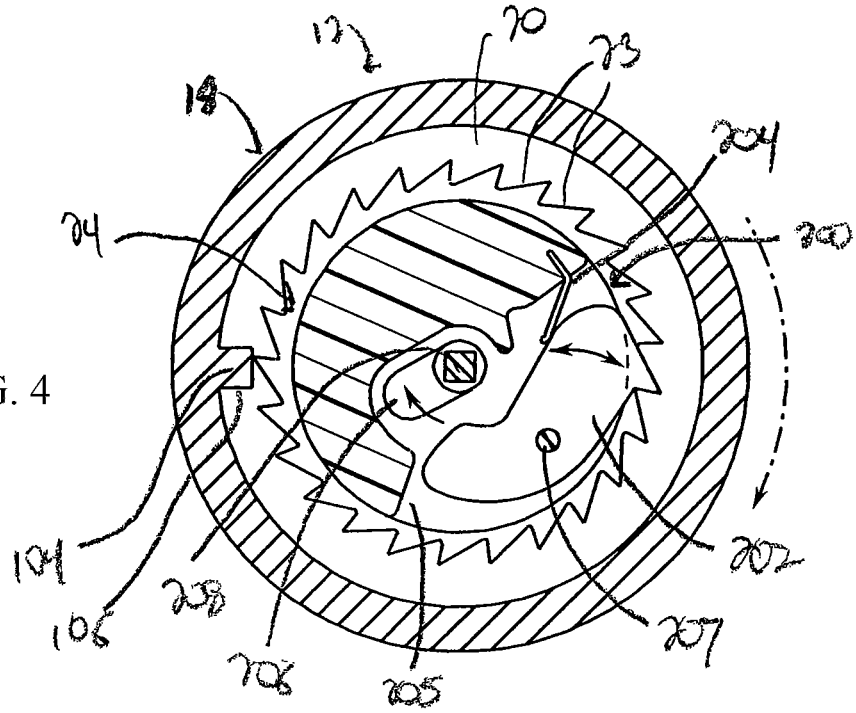
FIG. 4 a cross-sectional view along line 4-4 of FIG. 3 showing a ratchet mechanism for the lock in an engaged position.
Figure 5:
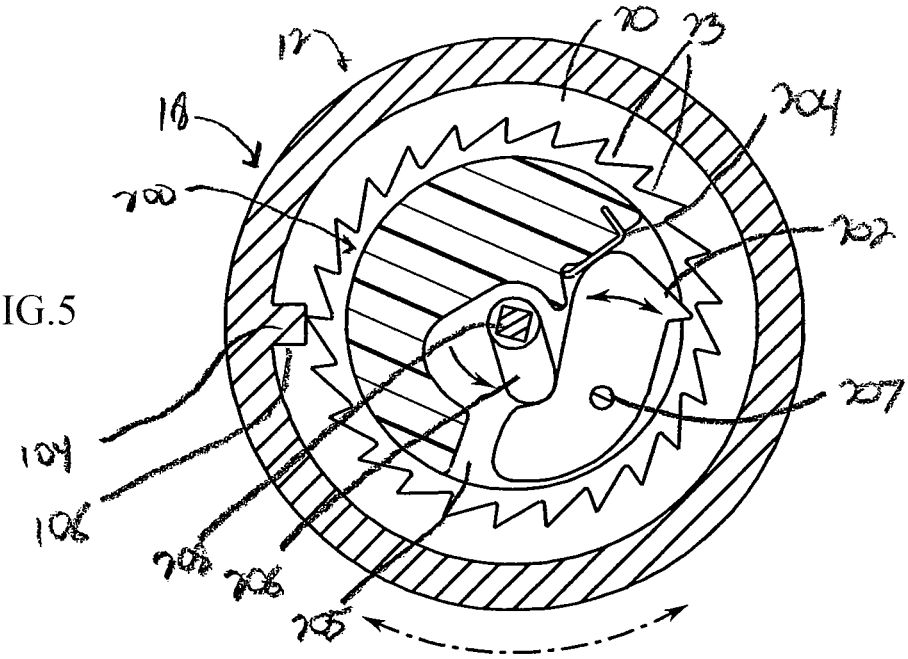
FIG. 5 is a cross-section view similar to FIG. 4 showing the ratchet mechanism for the lock in a disengaged position.
Figure 6:
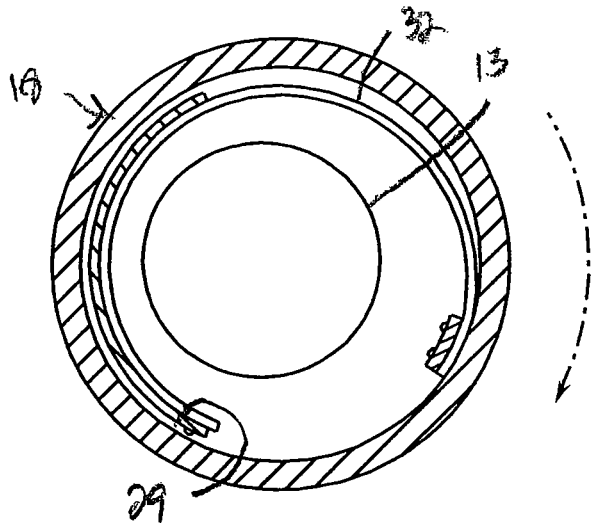
FIG. 6 is a cross-sectional view along line 6-6 of FIG. 3 showing the lock in a disengaged position.
Figure 7:
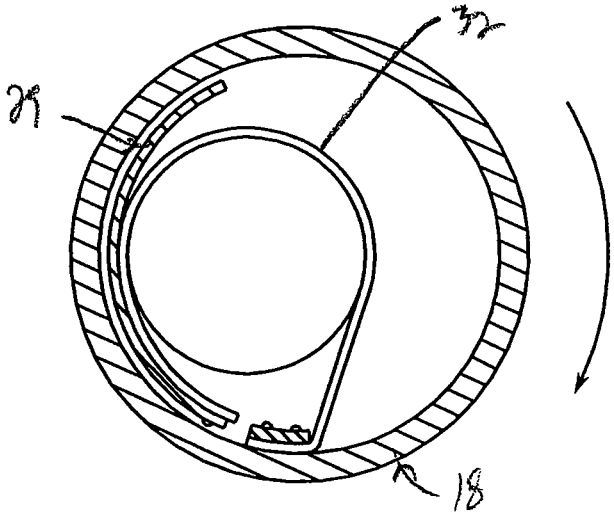
FIG. 7 is a cross-sectional view similar to FIG. 6 showing the lock in an engaged position.

When the mechanism 36 is positioned in the engaged position using the key 44, the rod 208 is rotated as a result of the rotation of the key 44. As stated previously, this rotation of the rod 208 moves the arm 206 in the ratcheting mechanism 24 to move the arm 206 away from the pawl 202. In this position, as shown in FIG. 4, the pawl 202 is urged into engagement with the teeth 23 as a result of the biasing member 204 to prevent the rotation of the lower housing 12 and the gear 20 in the counterclockwise direction. In this manner, the lower housing 12 and gear 20 can only move in a direction that causes the flexible engagement member 32 to be wrapped around the neck 13 of the bottle 11, as shown in FIG. 6. Once the flexible member 32 is securely engaged around the bottle neck 13, as sown in FIG. 7, the pawl 202 prevents the movement of the lower housing 12 in the opposite direction such that the lock 10 is secured over the neck 13.

However, when the key 44 is rotated in the opposite direction, the locking mechanism 36 is operated to rotate the rod 208 and arm 206 to disengage the pawl 202 from the gear 20, such that the lower housing 12 and the gear 20 can be rotated in either direction, allowing the lock 10 to be disengaged from the bottle 11.

In addition to the above embodiment, other alternatives are also contemplated as being within the scope of the present invention. For example, the ratcheting mechanism 24 can be located in positions outside of the opening 22 in the gear 20, such as in the upper housing 16, or on the gear 20, among others. Additionally, the form of the flexible engagement member 32 can have other alternative shapes and configurations. Further, the lock 10 can include any suitable sealing mechanism (not shown) that can prevent the contents of the bottle 11 or other container from exiting the bottle 11 when the bottle 11 and lock 10 are inverted or tilted.

Various other embodiments of the present invention are contemplated as being within the scope of the filed claims particularly pointing out and distinctly claiming the subject matter regarded as the invention.

The invention claimed is:

1. A lock comprising:

a) a lower housing including an engagement member attached thereto, the lower housing defines an interior with an open lower end;

b) a shaft directly engaged with the engagement member opposite the lower housing, the lower housing rotatable with respect to the shaft to move the engagement member;

c) a ratcheting mechanism operably connected to the lower housing to control the rotation of the lower housing relative to the shaft and to form a cover on the lower housing opposite the open end of the lower housing, the ratcheting mechanism and lower housing forming an enclosure around the interior of the lower housing accessible only via the open end; and d) a locking mechanism operably engaged with the ratcheting mechanism, the locking mechanism being selectively operable to control the operation of the ratcheting mechanism, wherein the engagement member does not project outwardly from the open lower end of the lower housing.

2. The lock of claim 1 further comprising an engagement structure operably connected between the shaft and the engagement member.

3. The lock of claim 2 wherein the engagement structure is rotatably connected to the lower housing.

4. The lock of claim 3 wherein the shaft is engaged within an opening in the engagement structure.

5. The lock of claim 1 wherein a material forming the engagement member is flexible.

6. The lock of claim 1 wherein the locking mechanism is disposed within an upper housing rotatably secured to the lower housing.

7. The lock of claim 6 wherein the ratcheting mechanism is engaged with the upper housing.

8. The lock of claim 1 wherein the lower housing includes a gear operably connected to the lower housing.

9. The lock of claim 8 wherein the gear includes an opening within which the ratcheting mechanism is disposed.

10. The lock of claim 1 further comprising a rod operably connected between the ratcheting mechanism and the locking mechanism.

11. The lock of claim 10 wherein the rod is engaged at one end with a disengagement arm disposed within the ratcheting mechanism.

12. The lock of claim 1 wherein the locking mechanism is a key-operated locking mechanism.

13. A method of selectively allowing access to the contents of a container, the method comprising the steps of:

a) providing a lock according to claim 1; and b) engaging the lock with the container.

14. The method of claim 13 wherein the step of engaging the lock comprises the steps of:

a) operating the locking mechanism to enable the lower housing to rotate in a single direction;

b) placing the lower housing over a neck of the container; and c) rotating the lower housing to wind the engagement member around the neck of the container.

15. The method of claim 13 further comprising the step of disengaging the lock from the container.

16. The method of claim 15 wherein the step of disengaging the lock from the container comprises the steps of:

a) operating the locking mechanism to enable the lower housing to rotate in two directions; and b) rotating the lower housing to unwind the engagement member from around the neck of the container.

17. A lock comprising:

a) a lower housing including an engagement member attached thereto, the lower housing defines an interior with an open lower end;

b) a shaft engaged with the engagement member opposite the lower housing, the lower housing rotatable with respect to the shaft to move the engagement member;

c) a ratcheting mechanism operably connected to the lower housing to control the rotation of the lower housing; and d) a locking mechanism, operably engaged with the ratcheting mechanism, the locking mechanism being selectively operable to control the operation of the ratcheting mechanism, wherein the engagement member does not project outwardly from the open lower end of the lower housing, and wherein the engagement member is adapted to wrap around a neck of a bottle around which the lower housing is positioned.

* * * * *